United States Patent [19]

Luke

[11] Patent Number: 4,714,083

[45] Date of Patent: Dec. 22, 1987

[54] MAKING OF MULTI-ELEMENT SMOKING ARTICLE ROD

[75] Inventor: John A. Luke, Eastleigh, England

[73] Assignee: British-American Tobacco Company Limited, London, England

[21] Appl. No.: 823,597

[22] Filed: Jan. 29, 1986

[30] Foreign Application Priority Data

Feb. 15, 1985 [GB] United Kingdom ..... 8503956

[51] Int. Cl.[4] ..... A24C 5/47

[52] U.S. Cl. ..... 131/94

[58] Field of Search ..... 131/280, 94

[56] References Cited

U.S. PATENT DOCUMENTS 3,551,256 12/1970 Watson ..... 131/94

4,185,941 1/1980 Molins et al. ..... 131/94

*Primary Examiner*—V. Millin

*Attorney, Agent, or Firm*—Kane, Dalsimer, Sullivan, Kurucz, Levy, Eisele and Richard

[57] ABSTRACT

Oval or other non-circular cross-section filter tipped cigarettes are assembled by feeding, in axial-orientation controlled manner, tobacco rods and filter rods along first and second feed paths to an intercalation station at which the filter rods are intercalated with the tobacco rods, closing the rods up to provide units each comprising two tobacco rods and an intermediately disposed filter rod, applying a wrapper to each unit to provide a double length cigarette assembly and severing the assembly to provide two cigarettes.

10 Claims, 8 Drawing Figures

MAKING OF MULTI-ELEMENT SMOKING ARTICLE ROD

This invention relates to the making of multi-element smoking article rod of non-circular cross-section.

In the making of filter tipped cigarettes it is the standard practice to assemble pairs of tobacco rods with filter elements of twice unit length disposed intermediate the tobacco rods and in abutment with ends of the respective rods. A tipping wrapper is then applied, at a margin thereof, to such assembly and the assembly is rolled, i.e. moved laterally of the axis of the assembly and rotated about the axis, against a rolling plate so as to cause the tipping wrapper to be wrapped completely around the assembly, thus to interattach the filter element and the tobacco rods. This standard practice method of making filter tipped cigarettes and apparatus for carrying out the method have been developed for use with tobacco rods and filter elements of circular cross-section. Although a proposal has been made in International patent application No. PCT/US84/00372 (published as No. WO84/03818) to roll an assembly of oval cross-section in order to apply a tipping wrapper thereto, the standard practice method is not readily adopted for the fully efficient production of cigarettes of non-circular cross-section.

In United Kingdom Patent Specification No. 709,202 there is described a method of making oval filter tipped cigarettes in which filter elements are fed into gaps in an unwrapped stream of tobacco. The continuous composite filler thus produced is then enclosed in a wrapper to form a continuous composite rod, which rod is subsequently severed at the mid points of the filter elements. The filter elements are initially of round cross-section and are fed between shaping members, with a view to deforming them to an oval cross-section, before or after the elements have been incorporated with the tobacco. This does not represent a practicable making method and has not to our knowledge been put into commercial practice.

Other proposals for methods of making filter tipped cigarettes in which continuous fillers comprising filter elements and tobacco are wrapped to provide a continuous composite rod are disclosed in United Kingdom Patent Specifications Nos. 615,435 and 1,485,131 and U.S. Pat. Nos. 2,423,554; 3,364,934 and 3,999,559.

United Kingdom Patent Specifications Nos. 430,742; 776,256; 782,415; 814,383; 814,385; 917,701 and 955,431 propose methods of making filter tipped cigarettes of circular cross-section in which filter elements and wrapped tobacco rod lengths are formed into assemblies while being moved lengthwise in axial alignment. No such methods have to our knowledge been put into commercial practice.

An object of the present invention is to provide a new and practicable method and apparatus for making multi-element smoking article rod of non-circular cross-section.

The present invention provides a method of making multi-element smoking article rod of non-circular cross-section, wherein first rod lengths of non-circular cross-section are guided lengthwise along a first feed path, serially and in axial-orientation controlled manner, to and through an intercalating station, second rod lengths of a cross-section similar to that of said first rod lengths are guided lengthwise along a second feed path, serially and in axial-orientation controlled manner, to said station, said second rod lengths are intercalated with said first rod lengths at said station so that the intercalated second rod lengths are co-axial with adjacent first rod lengths and are disposed with an axial orientation common with that of said adjacent first rod lengths, and downstream of said station the rod lengths are guided lengthwise and co-axially along a third feed path, with maintenance of the common axial orientation of first and second rod lengths, and preferably with next adjacent first rod lengths in abutment with the intercalated second rod length(s), to wrapping means, in operation of which wrapping means sheet wrapper material is applied to interattach first and second rod lengths.

The present invention also provides apparatus operable to make multi-element smoking article rod of non-circular cross-section, which apparatus comprises a first feed path extending to intercalating means, first feeding and guiding means operable to feed and guide first rod lengths of non-circular cross-section lengthwise along said first feed path serially and in axial-orientation controlled manner, a second feed path extending to said intercalating means, second feeding and guiding means operable to feed and guide second rod lengths of a cross-section similar to that of said first rod lengths lengthwise along said second feed path serially and in axial-orientation controlled manner, said intercalating means being operable to intercalate said second rod lengths with said first rod lengths so that the intercalated second rod lengths are co-axial with adjacent first rod lengths and are disposed with an axial orientation common with that of said adjacent first rod lengths, a third feed path extending from said intercalating means to wrapping means, and third feeding and guiding means operable to feed and guide the first and second rod lengths lengthwise and co-axially along said third feed path with maintenance of the common axial orientation of first and second rod lengths, and preferably with next adjacent first rod lengths in abutment with the intercalated second rod length(s), said wrapping means being operable to apply sheet wrapper material to interattach first and second rod lengths.

By use of the present invention it is possible to make multi-element smoking article rod with a wide range of cross-sections, including oval and rectilinear. Oval cross-sections may be generally elliptical or lenticular. Rectilinear cross-sections include square, rectangular and triangular. Another conceivable cross-sectional shape comprises two straight parallel sides joined by curved portions.

In order that the present invention may be clearly understood and readily carried into effect, reference will now be made, by way of example, to the diagrammatic drawings hereof, in which.

Figure 1:
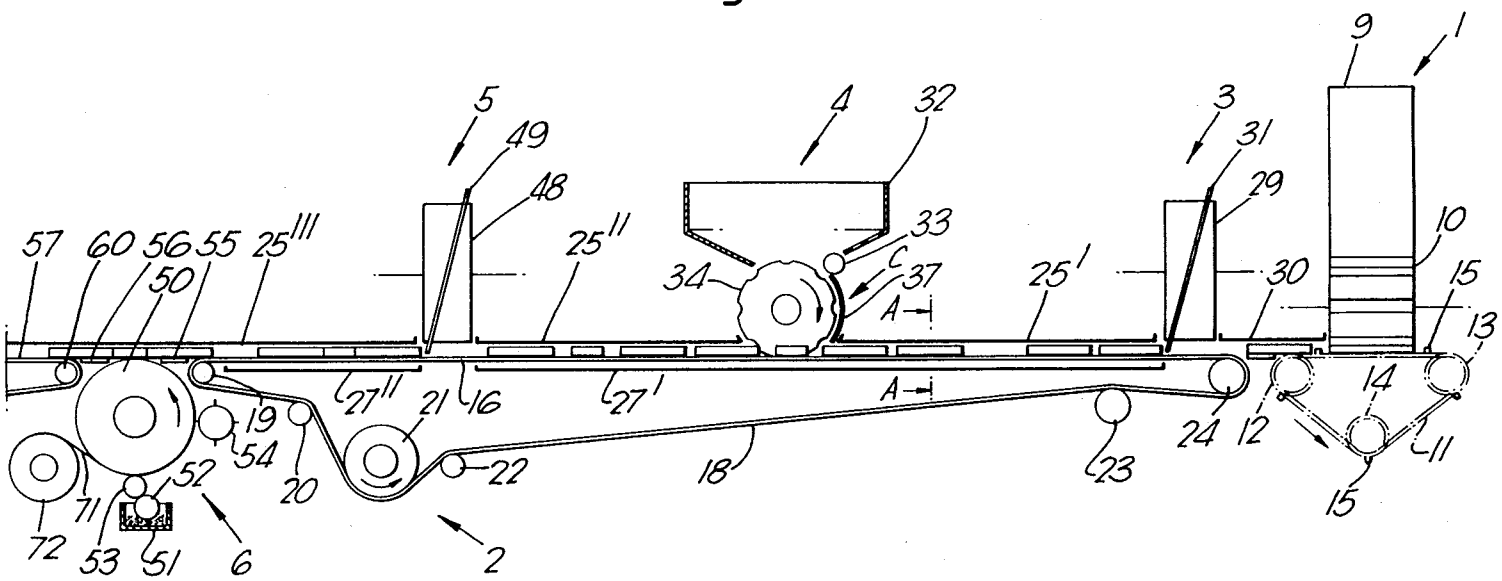
FIG. 1 shows in side elevation parts of apparatus operable to make oval cross-section tipped cigarettes from oval tobacco rod lengths and oval filter elements.

The apparatus illustrated in the diagrammatic drawings comprises supply unit 1, conveying unit 2, first spacing unit 3, intercalating unit 4, second spacing unit 5, wrapper application unit 6, folding unit 7 and cutting unit 8. The apparatus also comprises drive means, for the sake of simplicity not shown, operable to drive the units 1–7 in synchronised manner.

The supply unit 1 is operable to supply, in axial orientation controlled manner, oval tobacco rod lengths and comprises a hopper 9, a fluted drum 10 which is rotatable by the drive means and a feed chain 11 which is trained about three sprocket wheels 12–14. The chain 11 carries at equally spaced locations therealong five pusher pins 15. As may be seen from FIG. 1, an upper horizontal run of the chain 11 extends close to the lowermost part of the fluted drum 10. Thus as the chain 11 runs about the sprocket wheels 12–14, under the action of the drive means, pusher pins 15 pass along each flute of the drum 10 in turn, the direction of travel along the flutes being from right to left as viewing FIG. 1. The upper run of the chain 11 extends at a slight angle to the axis of rotation of the drum 10 so that as the pusher pins 15 pass along the upper run, the pins 15 have a component of movement in the direction of rotary movement of the flutes of the drum 10. It is thus arranged that the pins 15 pass through the flutes without coming into contact with the walls of the flutes.

The supply unit 1 further comprises a refuser roller associated with the hopper 9 and a rod retention guide of arcuate form associated with the drum 10. For the sake of simplicity these are not shown in FIG. 1 but they correspond to similar components 33 and 37 of the intercalating unit 4, described in detail hereinbelow, and have a corresponding function.

Figure 4:
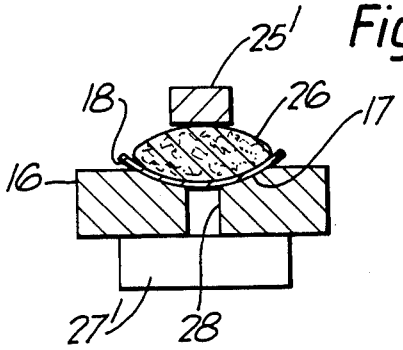
FIG. 4 shows, to an enlarged scale, a sectional view taken at line A—A of FIG. 1.

The conveying unit 2 comprises a horizontal, elongate bed 16, which bed is shown, in transverse cross-section, in FIG. 4. A shallow groove 17 of arcuate cross-section extends from end-to-end of the bed 16 at the upper surface thereof. An upper run of an endless band 18 of air pervious material is supported in the groove 17 and takes the curved form of the groove 17. The band 18 is trained about pulley wheels 19 and 20 and 22–24 and a drive wheel 21, the drive wheel 21 being drivable, in an anti-clockwise direction as viewing FIG. 1, by the drive means.

Intermediate the first spacing unit 3, the intercalating unit 4 and the second spacing unit 5 and downstream of the spacing unit 5 there extend above and in alignment with the groove 17 elongate locating bars 25',25'' and 25'''. As may be observed from FIG. 4, such is the cross-sectional curvature imposed on the band 18 by the shape of the groove 17 and such is the distance of the under surface of the locating bars 25'–25''' that oval tobacco rod lengths conveyed by the conveying unit 2 are maintained in a predetermined axial orientation. Thus the tobacco rod length 26 shown in cross-section in FIG. 4 is maintained with the major transverse dimension thereof horizontally disposed.

Beneath the bed 16 are secured suction boxes 27' and 27'', the first of which extends between the locations of the first and second spacing means 3,5, and the second of which extends downstream from the second spacing means 5. A series of openings spaced along the bed 16, one of which designated 28 is shown in FIG. 4, serve to incommunicate the suction boxes 27' and 27'' and the groove 17.

The first spacing unit 3 comprises a drum 29 which is rotatable by the drive means. The axis of the drum 29 is parallel to and located vertically above the bed 16. The lowermost part of the peripheral surface of the drum 29 is disposed at the same level as the underside of the locating bar 25', thus to provide continuity of orientation control means intermediate a locating bar 30, which extends between the drum 10 and the drum 29, and the bar 25'. Projecting from the peripheral surface of the drum 29 and extending along a helical path around a portion of the circumference of the drum 29 is a spacer ridge 31.

Figure 6:
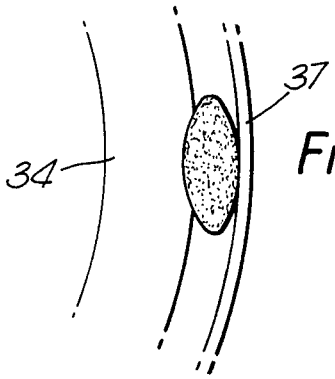
FIG. 6 shows a detail at the location designated C in FIG. 1.

The intercalating unit 4 is adapted to supply, in axial orientation controlled manner, double unit length filter elements of an oval cross-section corresponding to that of the tobacco rod lengths supplied by the supply unit 1. The intercalating unit 4 comprises a hopper 32, a refuser roller 33, a fluted drum 34, a feed chain 35 (FIG. 3) and a finger wheel 36. Associated with the drum 34 is an arcuate retention guide 37 (FIGS. 1 and 6). The roller 33, the drum 34, the chain 35 and the wheel 36 are drivable in synchronism by the drive means.

Figure 3:
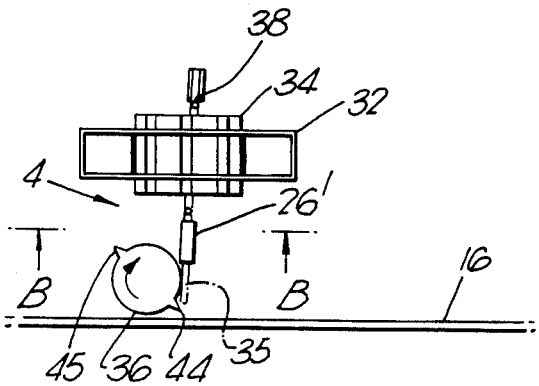
FIG. 3 shows a plan view of a portion of what is shown in FIG. 1.
Figure 5:
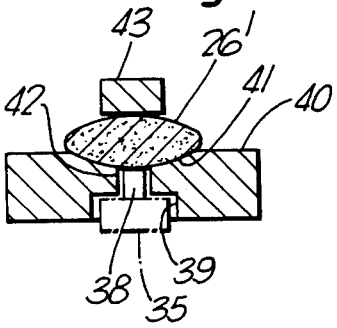
FIG. 5 shows a sectional view taken at line B—B of FIG. 3.

The feed chain 35 carries at equally spaced locations therealong pusher pins 38 (FIGS. 3 and 5). An upper run of the chain 35 extends in a recess 39 formed at the lower side of a bed 40. The bed 40 is provided at its upper surface thereof with a shallow groove 41 of arcuate cross-section. A continuous slot 42 serves to intercommunicate the groove 41 and the recess 39 and to permit the pusher pins to project into the groove 41. Above and in alignment with the bed 40 there extends a locating bar 43 to ensure orientation control of filter element 26'.

Figure 7:
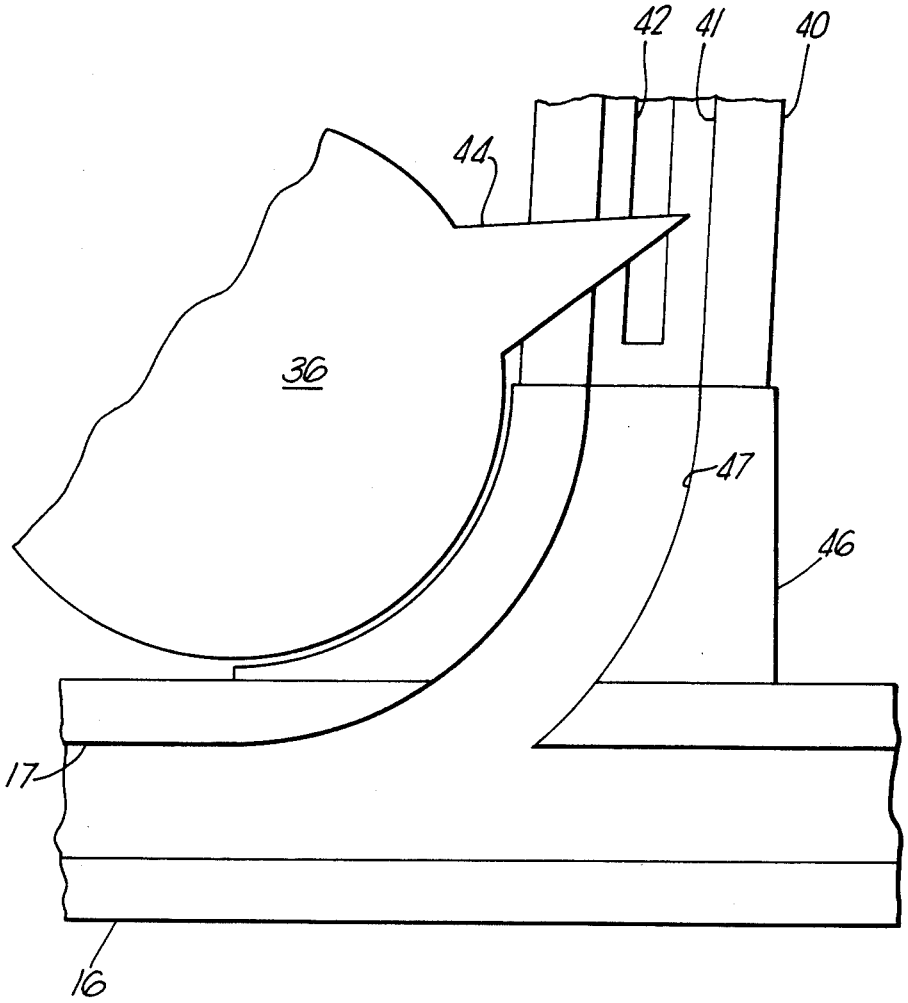
FIG. 7 shows a detailed view of part of what is shown in FIG. 3.

The finger wheel 36 carries, at diammetrically opposed locations, radially outwardly extending pusher fingers 44 and 45. Disposed adjacent the wheel 36 is a transfer plate 46 which is provided with a shallow groove 47 which, as can be seen from FIG. 7, follows a curved path concentric with the wheel 36 and interconnects the groove 41 of the bed 40 and the groove 17 of the bed 16. A curved locating bar, for the sake of simplicity not shown, extends above and in alignment with the groove 47.

The second spacing unit 5 is similar in construction to the first spacing unit 3 and comprises a drum 48 provided with a helical spacer ridge 49.

The wrapper application unit 6 comprises an applicator wheel 50, an adhesive bath 51, an adhesive pick-up wheel 52, an adhesive transfer wheel 53, and a cutter wheel 54 carrying radially projecting blades. Suction may be applied, by suction means (not shown), at the periphery of the applicator wheel 50 over that quadrant thereof which extends between the cutter wheel 54 and the uppermost part of the wheel 50. Short length beds 55 and 56, provided with grooves similar to the groove 17 of bed 16, are disposed one to each side of the uppermost part of the wheel 50. The wheels 50, 52, 53 and 54 are drivable in synchronism by the drive means.

The folding unit 7 comprises an endless band 57 which is trained about pulley wheels 58–60 and a drive wheel 61, the drive wheel 61 being drivable in an anti-clockwise direction by the drive means. An upper run of the band 57 extends through a folder or garniture 62, the interior passage of which is shaped in accordance with the oval cross-sectional shape of the filter elements and tobacco rod lengths. To the upstream and downstream sides respectively of the folder 62 the upper run of the band 57 is supported in grooves provided in beds 63 and 64, the grooves being similar to the groove 17 of the bed 16. A portion of the locating bar 25''' extends above the bed 63 and a similar locating bar, designated 65, extends above the bed 64.

A vacuum displacer wheel 66, of known type and rotatable by the drive means, is disposed immediately downstream of the folding unit 7. The displacer wheel 66 is operable to feed double cigarette assemblies from the folding unit 7 to the flutes of a fluted catcher drum 67 along a short length bed 68. As may be seen from FIG. 2, the drum 67 comprises at the mid point of its length an annular groove 69 into which projects a disc knife 70. The drum 67 and the knife 70 are rotatable by the drive means.

In operation of the apparatus to make oval cross-section tipped cigarettes, first rod lengths in the form of oval tobacco rod lengths are fed gravitationally from the hopper 9 to the flutes of the rotating drum 10, each flute in turn receiving a single tobacco rod length. As the chain 11 runs about the sprocket wheels 12–14 the pusher pins 15 push each tobacco rod length from the respective flute of the drum 10 onto the band 18 of the conveying unit 2. As alternate tobacco rod lengths are conveyed on the band 18 beneath the drum 29 of the first spacing unit 3, rotation of the drum 29 causes the spacer ridge 31 to come into contact with the upstream end face of the tobacco rod length and to cause the rod length to move forward at a velocity greater than that of the band 18. In this manner the space between the rod length contacted by the ridge 31 and the downstream end of the next succeeding rod length is increased.

During their conveyance from the spacing unit 3 to the intercalating unit 4 the tobacco rod lengths are maintained in common axial orientation by virtue of the curved section of the band 18 and the presence of the locating bar 25'.

Double unit length filter elements of oval cross-section, providing second rod lengths, are fed gravitationally from the hopper 32 of the intercalcating unit 4 one to each of the flutes of the rotating drum 34 of the unit 4. Movement of the pusher pins 38 on the chain 35 causes each filter element to be pushed from the respective flute of the drum 34 and to be conveyed along the groove 41 of the bed 40. When each filter element arrives adjacent the finger wheel 36 one of the pusher fingers 44, 45 contacts the upstream end face of the element, whereby the element is conveyed along the curved groove 47 of the transfer plate 46 and into the groove 17 of the bed 16. The element enters the groove 17 in a space between tobacco rod lengths which space has been increased to permit such intercalation by operation of the first spacing unit 3 on the first of the tobacco rod lengths. When the filter element arrives in the groove 17 it has a common axial orientation with that of the tobacco rod lengths with which it is intercalated.

During their conveyance from the intercalating unit 4 to the wrapper application unit 6 the tobacco rod lengths and the double unit length filter elements are maintained in common axial orientation by virtue of the curved section of the band 18 and the presence of the locating bars 25'' and 25'''. Prior to the filter elements and tobacco rod lengths arriving at the unit 6, rotation of the drum 48 of the second spacing unit 5 causes the spacer ridge 49 to come into contact with the upstream end face of the tobacco rod length next following each filter element, thereby to close the gaps between the filter element and the next leading and next following tobacco rod lengths. Thus the rod lengths and filter elements are conveyed to the unit 6 as double cigarette assemblies each comprising a double unit length filter element in abutment at each end with a tobacco rod length.

In operation of the wrapper application unit 6 the wheel 52 picks up adhesive from the bath 51, which adhesive is transferred by the wheel 53 to a web 71 of wrapper material extending from a reel 72 and in contact with the periphery of the applicator wheel 50. The blades of the cutter wheel 54 cut the web into discrete wrappers which are maintained in contact with the periphery of the wheel 50 under action of the aforementioned suction means. The peripheral velocity of the wheel 50 is the same as the linear velocity of the double cigarette assemblies, although the wrapper material web is fed to the wheel 50 at a lesser velocity. Immediately a discrete wrapper is cut from the web 71 the wrapper is free to assume the peripheral velocity of the wheel 50. The wrapper is thus spaced from the remainder of the web 71 and is carried upwardly by the wheel 50. The operation of the unit 6 is so timed in relation to the movement of double cigarette assemblies that as each assembly arrives at the unit 6, a discrete wrapper is brought into contact with the assembly. The wrapper adheres along a central region thereof to the filter element of the assembly and to a short portion of each of the tobacco rod lengths of the assembly.

Figure 2:
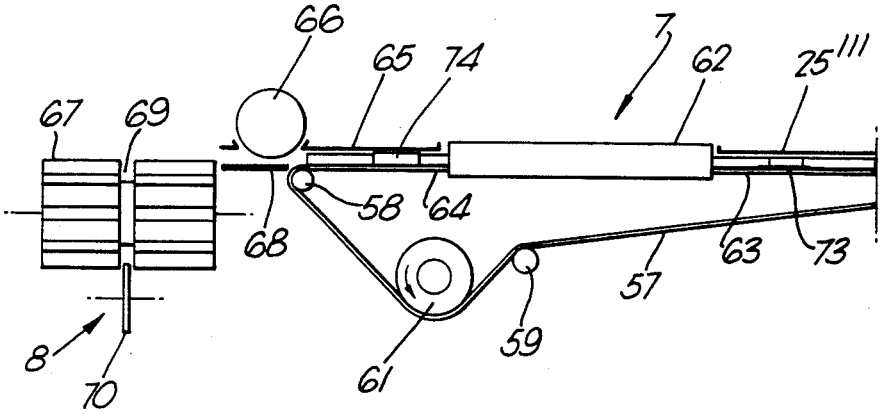
FIG. 2 shows in side elevation other parts of the apparatus of FIG. 1, which other parts extend leftwards of the parts shown in FIG. 1.

Double cigarette assemblies, with attached wrappers, pass from the unit 6 onto the moving band 57 of the folding unit 7 and are conveyed by the band 57 to the folder 62. The axial orientation of the assemblies is maintained by the groove in the bed 63 and by the portion of the locating bar 25''' which extends above the bed 63. As each assembly passes through the folder 62 the wrapper attached thereto is caused to be wrapped and lap seamed about the assembly, thereby to interattach the filter element and the tobacco rod lengths thereof. Wrappers of assemblies entering and leaving the folder 62 are indicated in FIG. 2 by reference numerals 73 and 74 respectively.

Upon leaving the unit 7 each double cigarette assembly is fed by the rotating displacer wheel 66 into a flute of the rotating fluted catcher drum 67. As the assemblies are conveyed by the drum 67 past the rotating disc knife 70 each assembly is severed to provide two cigarettes. Further conveying means may be provided to convey the cigarettes to a packing machine.

In the above described operation of the apparatus shown in the drawings tobacco rod lengths provide first rod lengths and double unit length filter elements provide second rod lengths which are intercalated with the first rod lengths. It is conceivable though for the first rod lengths to be double unit length filter elements and for tobacco rod lengths to be intercalated with an endwise moving and spaced stream of the filter elements.

Instead of the first rod lengths being fed from a hopper, as per hopper 9, they can, whether they be tobacco rod lengths or filter elements, be fed endwise from the cut-off unit of a rod making machine.

As above described the filter elements are fed by the intercalating unit 4 in such manner that initially there exists a gap at both ends of the element between the element and the adjacent tobacco rod lengths. In an alternative mode of operation of the intercalating means each second rod length is intercalated between spaced first rod lengths such that the second rod length is initially spaced only from the upstream first rod length and is in abutment with the downstream first rod length.

Although in the above described apparatus the feed paths along which the first and second rod lengths are conveyed endwise between the operational units of the apparatus are straight, it will be readily understood by those skilled in the art that one or more such paths could be curved in the horizontal and/or vertical plane.

Figure 8:
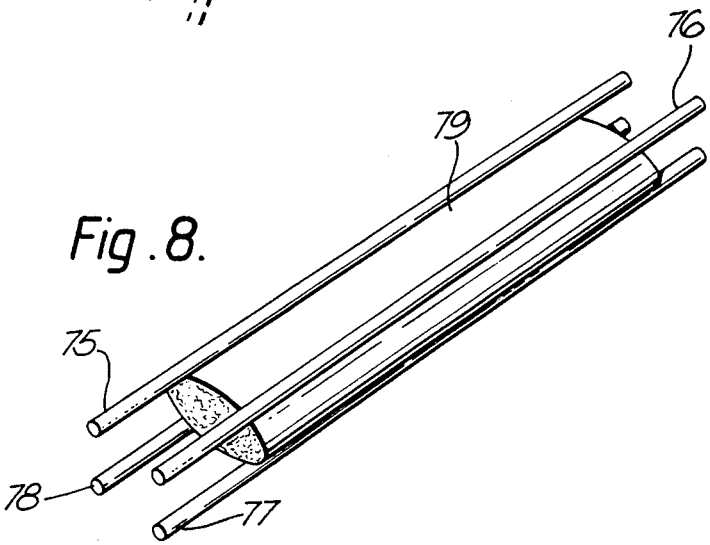
FIG. 8 shows a perspective view of a variant detail.

An alternative form of axial orientation control feed path comprises four runs of circular cross-section endless bands. This arrangement is shown in FIG. 8, in which figure reference numerals 75–78 designate portions of the respective band runs and reference numeral 79 designates a rod length.

One or both of the drum spacing units 3 and 5 could be replaced by a pneumatic nozzle means of the type described in United Kingdom Patent Specification No. 955,431.

Although as above described the apparatus operates to make double cigarette assemblies, which are then severed to provide two discrete cigarettes, the apparatus is readily adapted to assemble and wrap together unit length filter rods with single tobacco rod lengths to provide initially discrete cigarettes.

As above described the cross-section of the filter rod lengths is the same as the cross-section of the tobacco rod lengths. It is conceivable though that the cross-sections may be somewhat different. For example, when both cross-sections are oval the major or the minor dimension of the cross-section of the filter rod lengths can be different from the corresponding dimension of the tobacco rod lengths.

What is claimed is:

1. A method of making multi-element smoking article rod of non-circular cross-section, wherein first rod lengths of non-circular cross-section are guided lengthwise along a first feed path, serially and in axial-orientation controlled manner, to and through an intercalating station, second rod lengths of a cross-section similar to that of said first rod lengths are guided lengthwise along a second feed path, serially and in axial-orientation controlled manner, to said station, said second rod lengths are intercalated with said first rod lengths at said station so that the intercalated second rod lengths are co-axial with adjacent first rod lengths and are disposed with an axial orientation common with that of said adjacent first rod lengths, and downstream of said station the rod lengths are guided lengthwise and co-axially along a third feed path, with maintenance of the common axial orientation of first and second rod lengths, to wrapping means, in operation of which wrapping means sheet wrapper material is applied to interattach first and second rod lengths; and wherein one of said first and second rod lengths are tobacco rod lengths.

2. A method according to claim 1, wherein said second rod lengths are filter rod lengths.

3. A method according to claim 2, wherein in operation of said wrapping means said sheet wrapper material is applied to interattach two first rod lengths and an intermediately disposed second rod length.

4. A method according to claim 2, wherein when a second rod length is first intercalated between two first rod lengths at said intercalating station the second rod length is spaced from the upstream and the downstream first rod lengths.

5. A method according to claim 4, wherein downstream of said intercalating station next adjacent first rod lengths are brought into abutment with an intermediately disposed second rod length.

6. A method according to claim 2, wherein at said intercalating station each second rod length is at the downstream end thereof brought into abutment with the upstream end of a first rod length.

7. A method according to claim 2, wherein the cross-section of the first rod lengths is the same as the cross-section of the second rod lengths.

8. A method according to claim 2, wherein the first and the second rod lengths are of oval cross-section and a major or minor dimension of the cross-section of the first or the second rod lengths is greater than the corresponding dimension of the other of the first and second rod lengths.

9. Apparatus operable to make multi-element smoking article rod of non-circular cross-section, which apparatus comprises a first feed path extending to intercalating means, first feeding and guiding means operable to feed and guide first rod lengths of non-circular cross-section lengthwise along said first feed path serially and in axial-orientation controlled manner, a second feed path extending to said intercalating means, second feeding and guiding means operable to feed and guide second rod lengths of a cross-section similar to that of said first rod lengths lengthwise along said second feed path serially and in axial-orientation controlled manner, said intercalating means being operable to intercalate said second rod lengths with said first rod lengths so that the intercalated second rod lengths are co-axial with adjacent first rod lengths and are disposed with an axial orientation common with that of said adjacent first rod lengths, a third feed path extending from said intercalating means to wrapping means, and third feeding and guiding means operable to feed and guide the first and second rod lengths lengthwise and co-axially along said third feed path with maintenance of the common axial orientation of first and second rod lengths, and spacing means operable to vary the spacing of adjacent first and second rod lengths so that the second rod lengths are in abutment at either end with first rod lengths, said wrapping means being operable to apply sheet wrapper material to interattach first and second rod length assemblies.

10. Apparatus according to claim 9 and further comprising spacing means at said first feed path, said spacing means being operable to vary the spacing of next adjacent first rod lengths during the feed thereof along said first feed path.

* * * * *